United States Patent [19]

O'Callaghan

[11] Patent Number: 4,783,868

[45] Date of Patent: Nov. 15, 1988

[54] VANE FOR UNDERLIQUID CLEANING DEVICE

[76] Inventor: James S. O'Callaghan, R.F.D. 2, Meredith, N.H. 03253

[21] Appl. No.: 129,450

[22] Filed: Dec. 7, 1987

[51] Int. Cl.[4] ..... E04H 3/20; A46B 15/00

[52] U.S. Cl. ..... 15/1.7; 15/160

[58] Field of Search ..... 15/1.7, 160, 398–400

[56] References Cited

U.S. PATENT DOCUMENTS

| | | | |
|---|---|---|---|
| 2,243,576 | 5/1941 | Otto | 15/1.7 X |
| 3,003,168 | 10/1961 | Shouldice | 15/1.7 |
| 4,733,427 | 3/1988 | Conrad | 15/1.7 X |

FOREIGN PATENT DOCUMENTS

| | | | |
|---|---|---|---|
| 1068216 | 4/1960 | Fed. Rep. of Germany | 15/1.7 |
| 584029 | 1/1947 | United Kingdom | 15/1.7 |

*Primary Examiner*—Peter Feldman

*Attorney, Agent, or Firm*—Thomas N. Tarrant

[57] ABSTRACT

A swimming pool cleaning brush is disclosed having a pivotal vane that uses fluid dynamics for increasing contact pressure of the brush with the surfaces being cleaned during forward motion and then pivots to a nonimpeding position upon backward motion. The vane is designed to enable after market installation and is economically formed from two or three pieces of flat metal or plastic with necessary fasteners.

12 Claims, 2 Drawing Sheets

VANE FOR UNDERLIQUID CLEANING DEVICE

BACKGROUND OF THE INVENTION

1. Field of the Invention:

The present invention relates to brushes for cleaning underwater surfaces and particularly to hydrodynamic flow vanes for increasing contact pressure against a surface being cleaned by motion of an abrasive cleaning device.

2. Relation to the Prior Art:

In brushing the sides of a swimming pool, it is awkward and difficult to maintain any kind of forceful contact by the brush against the sides of the pool. This has led to a number of innovative devices to utilize the dynamics of liquid flow to provide the desired contact pressure. The flow vane of Otto, U.S. Pat. No. 2,243,576 was a simple rectangular plate pivotally mounted at the ends of the brush. The spacing between the plate and the back of the brush limited the pivotal movement of the vane so that it provided equal pressure to the brush on both up and down strokes.

Shouldice in U.S. Pat. No. 3,003,166 describes a similar but more complex vane having a more balanced structure with blades extending both ways from the pivotal axis. The blade nearer the brush is captured in a housing and its movement is limited by the housing lips. Again the limits are the same for both directions of motion.

Gibellina in U.S. Pat. No. 3,402,413, discloses a non-pivotal vane that is shaped to produce greater contact pressure on a forward stroke than on a reverse stroke.

Feinberg in U.S. Pat. No. 4,637,087 provides a fixed vane with a plurality of apertures blocked by check valves so as to reduce the contact pressure on the return stroke.

Both of the latter two patents recognized the value of reducing flow impedance on the return stroke. Both also provided devices that were adaptable to after market use. They are readily attachable to preexisting brushes.

The present invention returns to the pivotal simplicity of the Otto patent with a device that has lower return stroke impedance than any of the references and is well adapted to after market use.

SUMMARY OF THE INVENTION

In accordance with the present invention, an underwater abrasive cleaning device is provided with a vane that is pivotally mounted on a bracket assembly. The bracket assembly is mounted to hold the vane in spaced relation to the back of the device and carries vane stops assymetrically disposed relative to the pivotal points such that forward motion of the device in a liquid medium causes the vane to pivot to a position producing fluid pressure pushing the device against the surface being cleaned while reverse motion causes the vane to pivot to a nonimpeding position. Both bracket and vane may be stamped from sheet metal.

Thus it is an object of the invention to provide an economical vane for forcing an underwater cleaning device against a surface to be cleaned during a forward cleaning stroke, while offering minimum resistance during a return stroke.

Further objects and features of the invention will become apparent upon reading the following description together with the drawing.

DESCRIPTION OF THE PREFERRED EMBODIMENTS

The invention is intended for use with any abrasion device for cleaning a surface underneath a liquid. Brushes, scrapers, wipers and related devices operated manually with a pole-type handle are all included. The invention was developed in relation to cleaning the surfaces of an artificial swimming pool and will be described in that connection with no limiting intent.

Figure 1:
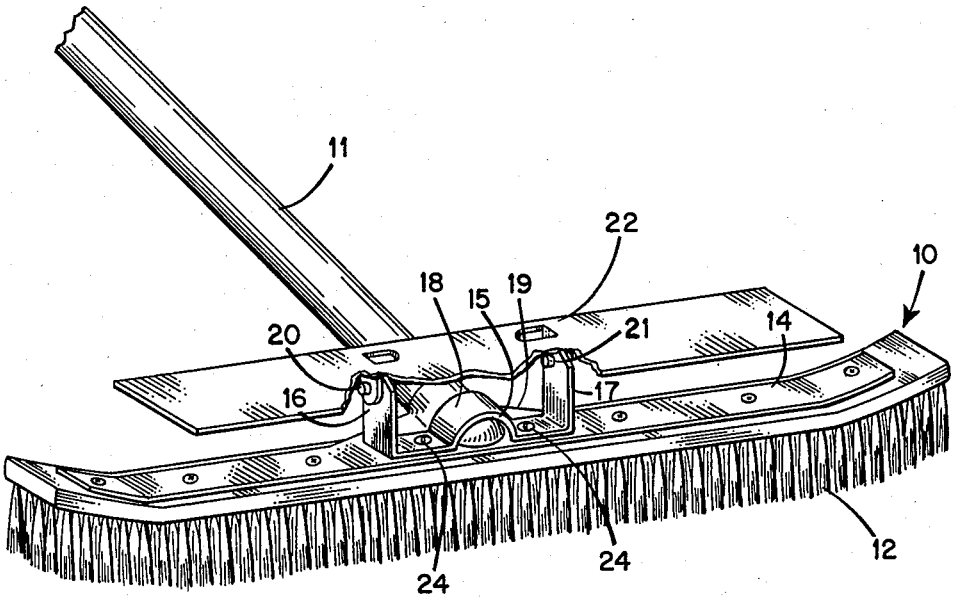
FIG. 1 is an assembly drawing of the invention in perspective partially cut-away to show detail.
Figure 2:
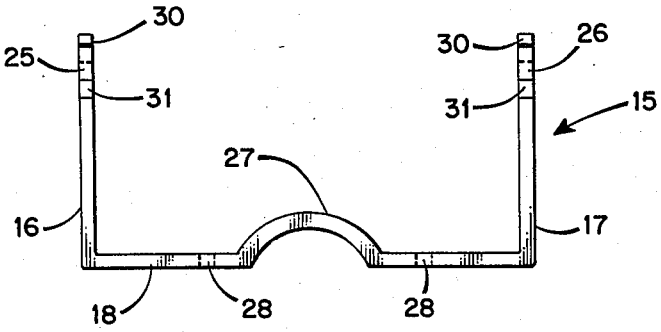
FIG. 2 is a front elevation of the vane support bracket of the invention.

FIG. 1 depicts a common type of swimming pool cleaning brush, 10. Brush 10 cleans by means of bristles 12 and is manipulated by pole 11 connected to brush back 14 which holds bristles 12. In accordance with the invention, bracket 15 is bolted to back 14 by two bolts 24. While FIG. 2 depicts bolts 24 as passing through the central portion of back 14, a more convenient connection is usually available. It is common for brushes 10 to have web 19 extending from back 14 to a handle portion for receiving pole 11. Bolts 24 can then mount bracket 15 to back 14 by passing through apertures drilled in web 19.

Bracket 15 is shaped like an inverted "U" with lateral member 18 humped at central portion 27 to allow for a handle portion of back 14. Apertures 28 on either side of central portion 27 are bolt holes for bolts 24.

Looking at brush 10 in FIG. 1, bracket 15 has two vertical arms. Left arm 16 and right arm 17 have apertures 25 and 26 respectively near their upper ends. Apertures 25 and 26 accept pivots 20 and 21 respectively for connecting vane 22 to bracket 15. Pivots 20 and 21 are suitably pivot pins such as rivets. The upper ends of arms 16 and 17 are finished off with forward motion stops 31 and reverse motion stops 30.

Vane 22 is substantially rectangular with either rounded or square corners. The area of vane 22 is desirably in the range of 50% to 100% of the bristle end surface of brush 10. While any amount of vane area aids surface contact, vane area less than 50% of brush area produces noticeably less than optimum affect and vane area greater than the brush area increases the bulk and wieldability of the brush to an undesired extent.

Figure 4:
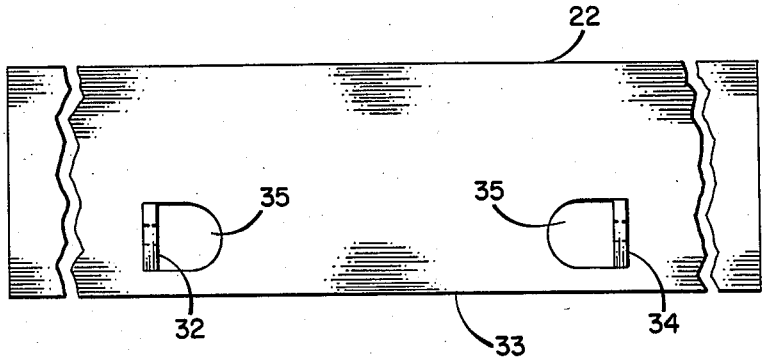
FIG. 4 is a bottom plan view of a vane according to the invention.
Figure 5:
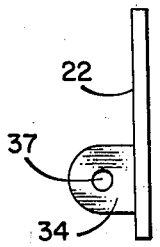
FIG. 5 is a right side elevation of the vane of FIG. 4.

A preferred means of adapting vane 22 for connection to pivots 20 and 21 is depicted in FIGS. 4 and 5. Tabs 32 and 34 are punched out of vane 22 which is suitably a sheet of aluminum. Tabs 32 and 34 have pivot apertures 37 for receiving pivots 20 and 21. Punching out of tabs 32 and 34 leaves apertures 35 in vane 22. Tabs 32 and 34 are located behind the lateral axis of vane 22 toward the trailing edge of the vane as the brush is pushed forward. The exact location is not critical, but they have been placed just far enough from the trailing edge to leave enough metal for good structural integrity.

Figure 3:
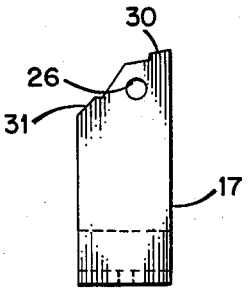
FIG. 3 is a right side elevation of the bracket of FIG. 2

Referring to FIG. 3, return stops 30 are preferably positioned to keep vane 22 angled forward at 5° to 15° relative to pole 11. This provides a bias to ensure that forward motion of the device in a liquid will cause vane 22 to rotate further until it strikes stops 31. Stops 31 are positioned to stop vane 22 at a forward angle 45° relative to pole 11. The angle of 45° is not critical, but it is the preferred deflection angle when pole 11 is parallel with the surface being cleaned.

Figure 6:
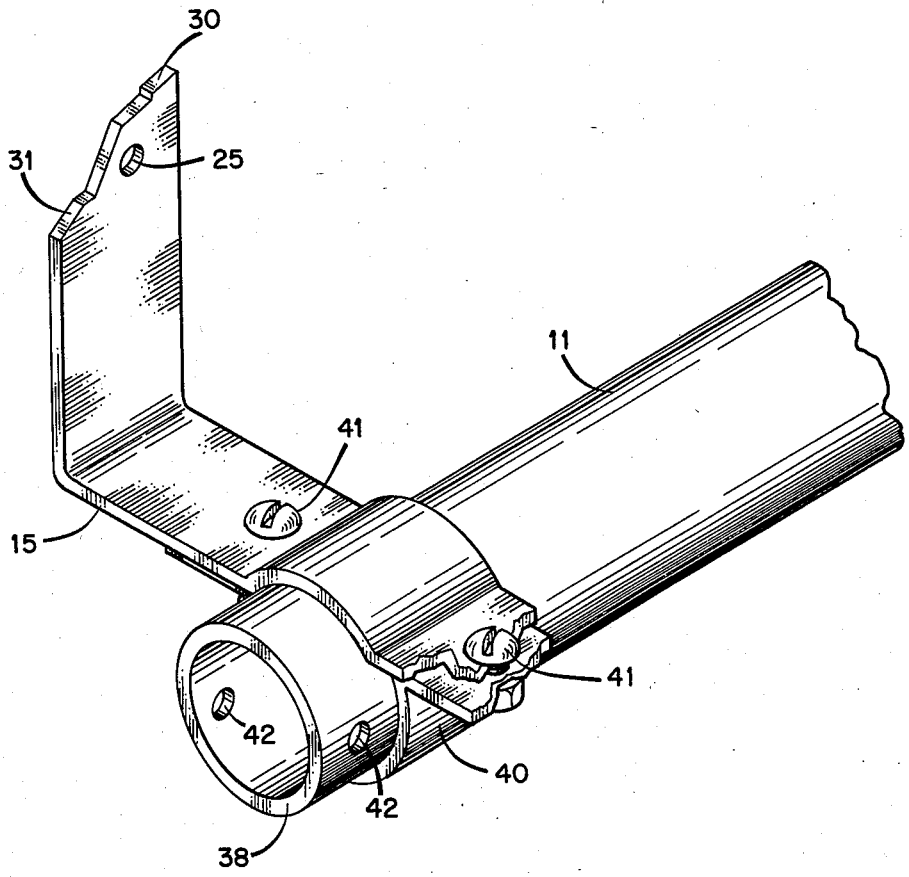
FIG. 6 is an alternative embodiment of a vane support bracket shown in perspective with the right end cut-away.

The bracket and vane assembly may also be mounted on pole 11 instead of brush 10. FIG. 6 depicts one style of pole 11 that is hollow so that end 38 may fit over a stub pole (not shown) integral with brush 10. Apertures 42 are for capturing detents on the stub pole. Bracket 15 is mounted to pole by cylindrical clamp 40 passing under pole 11 and secured to bracket 15 by two bolts 41.

While the invention has been described with respect to specific embodiments, variations within the state of the art are contemplated. The materials used can be various metals and/or plastics and can be stamped, molded, cast or otherwise shaped. The vane is preferably rectangular, but can also be oval or other desired shape.

Thus, it is intended to cover the invention as set forth in the following claims.

I claim:

1. An underliquid-brush vane assembly comprising:

(a) a bracket assembly securable to an underliquid brush device for holding a vane plate in spaced relation to the back of said brush device;

b) a vane plate pivotally secured to said bracket assembly at pivot points on said bracket assembly; and, (c) stops on said bracket assembly positioned assymetrically relative to said pivot points and limiting the rotational movement of said plate, whereby forward motion of a brush device, to which said bracket assembly is secured, in a liquid causes said plate to pivot to a position producing fluid pressure aiding contact of said brush with an adjacent surface while reverse motion of said brush causes said plate to pivot to a position of minimum impedance to movement.

2. An underliquid-brush vane assembly according to claim 1 wherein said bracket assembly comprises a lateral member with two arms extending at substantially right angles from opposite ends of said member, each arm having a pivot aperture proximate its outer end, a forward motion stop between said lateral member and said pivot point and a reverse motion stop at the end of the arm.

3. An underliquid-brush vane assembly according to claim 1 wherein said vane plate is stamped from sheet aluminum and two pivot point apertures are provided in tabs that are punched out of the plate at right angles.

4. An underliquid-brush vane assembly according to claim 1 wherein said bracket assembly includes a clamp member for clamping said bracket device to a pole part of said brush device.

5. An underliquid-brush vane assembly according to claim 1 wherein said stops on said bracket assembly are terminal edges of said bracket assembly.

6. An underliquid surface cleaning device comprising:

(a) an abrasion element;

(b) a pole secured to said abrasion element for manipulation of the abrasion element against an underliquid surface;

(c) a substantially rectangular vane element;

(d) a bracket secured to said cleaning device and pivotally supporting said vane element in spaced relation to said cleaning device, said bracket having at least two stops limiting pivotal movement of said vane element such that forward motion of the cleaning device causes the vane element to pivot to a position where the liquid flow urges the abrasion element in contact with the surface to be cleaned while reverse motion of the cleaning device causes the vane element to pivot to a substantially nonimpeding position.

7. An underliquid-surface cleaning device according to claim 6 wherein said at least two stops are two rear stops and two front stops, said rear stops positioned to keep said vane element angled forward at 5° to 15° relative to said pole to ensure that forward motion of the device in a liquid will cause the vane to rotate further forward until it strikes the front stops.

8. An underliquid-surface cleaning device according to claim 7 wherein said vane element is a substantially rectangular element having a lateral axis and has two spaced depending tabs located behind the lateral axis of the vane and connected by pivot pins to said bracket at positions between said front stops and said rear stops.

9. An underliquid-surface cleaning device according to claim 8 wherein said vane element including tabs is stamped from a single piece of flat metal and said bracket including front and rear stops is formed from a single piece of flat metal.

10. An underliquid-surface cleaning device according to claim 6 wherein said bracket is mounted to said pole by a clamp passing under said pole.

11. An underliquid-surface cleaning device according to claim 6 wherein said bracket is mounted to said abrasion element by fasteners.

12. An underliquid-surface cleaning device according to claim 6 wherein said abrasion element is a brush.

* * * * *